US006690331B2

(12) United States Patent
Apotolos

(10) Patent No.: US 6,690,331 B2
(45) Date of Patent: Feb. 10, 2004

(54) BEAMFORMING QUAD MEANDERLINE LOADED ANTENNA

(75) Inventor: John T. Apotolos, Merrimack, NH (US)

(73) Assignee: Bae Systems Information and Electronic Systems Integration INC, Nashua, NH (US)

( * ) Notice: Subject to any disclaimer, the term of this patent is extended or adjusted under 35 U.S.C. 154(b) by 0 days.

(21) Appl. No.: 10/246,659

(22) Filed: Sep. 18, 2002

(65) Prior Publication Data

US 2003/0025638 A1 Feb. 6, 2003

Related U.S. Application Data

(63) Continuation-in-part of application No. 09/870,875, filed on May 31, 2001, now Pat. No. 6,492,953, which is a continuation-in-part of application No. 09/865,115, filed on May 24, 2001, now Pat. No. 6,323,814.

(60) Provisional application No. 60/208,195, filed on May 31, 2000, provisional application No. 60/206,926, filed on May 24, 2000, and provisional application No. 60/206,922, filed on May 24, 2000.

(51) Int. Cl.[7] ..... H01Q 11/14

(52) U.S. Cl. ..... 343/744; 343/741; 343/745

(58) Field of Search ..... 343/741, 742, 343/743, 744, 745, 750, 752, 829, 846, 866, 867; H01Q 11/14

(56) References Cited

U.S. PATENT DOCUMENTS

| | | | | |
|---|---|---|---|---|
| 3,633,207 | A | | 1/1972 | Ingerson |
| 4,243,990 | A | | 1/1981 | Nemit et al. |
| 4,293,858 | A | | 10/1981 | Hockham |
| 4,656,482 | A | | 4/1987 | Peng |
| 4,804,965 | A | | 2/1989 | Roederer |
| 5,086,301 | A | | 2/1992 | English et al. |
| 5,481,272 | A | | 1/1996 | Yarsunas |
| 5,563,616 | A | | 10/1996 | Dempsey et al. |
| 5,784,032 | A | | 7/1998 | Johnson et al. |
| 5,790,080 | A | | 8/1998 | Apostolos |
| 5,867,126 | A | | 2/1999 | Kawahata et al. |
| 5,898,409 | A | | 4/1999 | Holzman |
| 5,926,139 | A | | 7/1999 | Korisch |
| 5,936,587 | A | | 8/1999 | Gudilev et al. |
| 6,008,762 | A | | 12/1999 | Nghiem |
| 6,025,812 | A | | 2/2000 | Gabriel et al. |
| 6,034,637 | A | | 3/2000 | McCoy et al. |
| 6,061,035 | A | | 5/2000 | Kinasewitz et al. |
| 6,094,170 | A | | 7/2000 | Peng |
| 6,166,694 | A | | 12/2000 | Ying |
| 6,313,716 | B1 | | 11/2001 | Apostolos |
| 6,323,814 | B1 | | 11/2001 | Apostolos |
| 6,373,440 | B2 | | 4/2002 | Apostolos |
| 6,384,792 | B2 | | 5/2002 | Apostolos |
| 6,480,158 | B2 | * | 11/2002 | Apostolos ..... 343/700 MS |
| 6,486,844 | B2 | * | 11/2002 | Thursby et al. ..... 343/744 |
| 6,489,925 | B2 | * | 12/2002 | Thursby et al. ..... 343/700 MS |
| 6,492,953 | B2 | * | 12/2002 | Apostolos ..... 343/744 |
| 6,590,543 | B1 | * | 7/2003 | Apostolos ..... 343/742 |
| 6,597,321 | B2 | * | 7/2003 | Thursby et al. ..... 343/744 |
| 2002/0008668 | A1 | | 1/2002 | Apostolos |

FOREIGN PATENT DOCUMENTS

| | | |
|---|---|---|
| WO | wo 98/49742 | 11/1998 |
| WO | wo 01/13464 | 2/2001 |

OTHER PUBLICATIONS

Lorenz, Robert G. and Boyd, Stephen P., Robust Beamforming in GPS Arrays, ION National Technical Meeting, Jan. 28–30, 2002, pp. 1–19 San Diego, CA.

* cited by examiner

*Primary Examiner*—Tho Phan
(74) *Attorney, Agent, or Firm*—Maine & Asmus

(57) ABSTRACT

Meanderline loaded antennas having a wide bandwidth available for simultaneous or instantaneous use are disclosed. In one embodiment, the azimuthal angle of arrival associated with the antenna is provided by phase difference between signals at the RHCP and Vpol ports or by phase difference between signals at the LHCP and Vpol ports. In another embodiment, a quad meanderline loaded antenna is adapted to simultaneously provide four independent beams. Any beam direction can be synthesized by combining the independent beams.

20 Claims, 7 Drawing Sheets

BEAMFORMING QUAD MEANDERLINE LOADED ANTENNA

RELATED APPLICATIONS

This application is a continuation-in-part of U.S. application Ser. No. 09/870,875, filed May 31, 2001 now U.S. Pat. No. 6,492,953 (claims the benefit of U.S. Provisional Application No. 60/208,195, filed May 31, 2000), which is a continuation-in-part of U.S. application Ser. No. 09/865,115, filed May 24, 2001, now U.S. Pat. No. 6,323,814 (claims the benefit of U.S. Provisional Application Nos. 60/206,926 and 60/206,922, each filed May 24, 2000). Each of these applications is herein incorporated by reference in its entirety.

FIELD OF THE INVENTION

The present invention relates to antennas and, more specifically to quadrature meanderline loaded antennas.

BACKGROUND OF THE INVENTION

In the past, efficient antennas have typically required structures with minimum dimensions on the order of a quarter wavelength of the lowest operating frequency. These dimensions allowed the antenna to be excited easily and to be operated at or near resonance, limiting the energy dissipated in impedance losses and maximizing the transmitted energy. However, such antennas tended to be large in size at the resonant wavelength, and especially so at lower frequencies.

In order to address the shortcomings of traditional antenna design and functionality, the meanderline loaded antenna (MLA) was developed. U.S. Pat. Nos. 5,790,080 and 6,313,716 each disclose meanderline loaded antennas. Both of these patents are hereby incorporated by reference in their entirety.

Generally, an MLA (also known as a "variable impedance transmission line" or VITL antenna) is made up of a number of vertical sections and horizontal sections. The vertical and horizontal sections are separated by gaps. Meanderlines are connected between at least one of the vertical and horizontal sections at the corresponding gaps. A meanderline is designed to adjust the electrical (i.e., resonant) length of the antenna, and is made up of alternating high and low impedance sections. By switching lengths of the meanderline in or out of the circuit, time delay and phase adjustment can be accomplished.

In addition, an MLA allows the physical dimensions of antennas to be significantly reduced while maintaining an electrical length that is still a multiple of a quarter wavelength. Antennas and radiating structures built using this design operate in the region where the limitation on their fundamental performance is governed by the Chu-Harrington relation. Meanderline loaded antennas achieve the efficiency limit of the Chu-Harrington relation while allowing the antenna size to be much less than a quarter wavelength at the frequency of operation. Substantial height reductions can be achieved over quarter wave monopole antennas while achieving comparable gain.

Thus, meanderline loaded antennas provide certain benefits over conventional antennas. However, although a switchable meanderline allows the antennas to have a very wide tunable bandwidth, the bandwidth available for simultaneous or instantaneous use is relatively limited. As such, meanderline loaded antennas can be limited for certain applications, such as multi-band or multi-use applications, or those where signals can appear unexpectedly over a wide frequency range. Moreover, the need for wideband or multi-band antennas continues to grow in response to requirements for aperture and volumetric efficiency for antennas used in systems such as wireless and satellite applications (e.g., GPS and cellular telephone platforms).

What is needed, therefore, are meanderline loaded antennas having a wide bandwidth available for simultaneous or instantaneous use.

BRIEF SUMMARY OF THE INVENTION

One embodiment of the present invention provides a quad meanderline loaded antenna adapted to simultaneously provide RHCP, LHCP, and Vpol modes. The antenna includes a first pair of opposed meanderline loaded antennas, and a second pair of opposed meanderline loaded antennas in orthogonal relationship with the first pair of opposed meanderline loaded antennas. A first inverse hybrid is operatively coupled to the first pair of opposed meanderline loaded antennas, and is configured with a "0" input/output port and a "180" input/output port. A second inverse hybrid is operatively coupled to the second pair of opposed meanderline loaded antennas, and is configured with a "0" input/output port and a "180" input/output port. A quadrature hybrid is operatively coupled to the "180" input/output ports of the first and second inverse hybrids, and is configured with a left-hand circularly polarized (LHCP) signal port and a right-hand circularly polarized (RHCP) signal port. A combiner/splitter is operatively coupled to the "0" input/output ports of the first and second inverse hybrids, and is configured with a vertically polarized (Vpol) signal port. With this particular embodiment, an azimuthal angle of arrival associated with the antenna is provided by phase difference between signals at the RHCP and Vpol ports or by phase difference between signals at the LHCP and Vpol ports.

Another embodiment of the present invention provides a quad meanderline loaded antenna adapted to simultaneously provide four independent beams. The antenna includes a first pair of opposed meanderline loaded antennas, and a second pair of opposed meanderline loaded antennas in orthogonal relationship with the first pair of opposed meanderline loaded antennas. A first inverse hybrid is operatively coupled to the first pair of opposed meanderline loaded antennas, and is configured with a "0" input/output port and a "180" input/output port. A second inverse hybrid is operatively coupled to the second pair of opposed meanderline loaded antennas, and is configured with a "0" input/output port and a "180" input/output port. A first quadrature hybrid is operatively coupled to the "0" input/output port of the first inverse hybrid, and to the "180" input/output port of the second inverse hybrid, and is configured with a north signal port and a south signal port. A second quadrature hybrid is operatively coupled to the "0" input/output port of the second inverse hybrid, and to the "180" input/output port of the first inverse hybrid, and is configured with an east signal port and a west signal port.

Another embodiment of the present invention provides a method for manufacturing a quad meanderline loaded antenna. The method includes providing a first pair of opposed meanderline loaded antennas, and a second pair of opposed meanderline loaded antennas in orthogonal relationship with the first pair of opposed meanderline loaded antennas. The method further includes operatively coupling a first inverse hybrid to the first pair of opposed meanderline loaded antennas, the first inverse hybrid configured with a "0" input/output port and a "180" input/output port. The method further includes operatively coupling a second inverse hybrid to the second pair of opposed meanderline loaded antennas, the second inverse hybrid configured with a "0" input/output port and a "180" input/output port. The method further includes operatively coupling a first quadrature hybrid to the "0" input/output port of the first inverse hybrid, and to the "180" input/output port of the second inverse hybrid, the first quadrature hybrid configured with a north signal port and a south signal port. The method further includes operatively coupling a second quadrature hybrid to the "0" input/output port of the second inverse hybrid, and to the "180" input/output port of the first inverse hybrid, the second quadrature hybrid configured with an east signal port and a west signal port.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION OF THE INVENTION

The principles of the present invention can be employed to provide an enhanced meanderline loaded antenna, which exhibits a wide instantaneous bandwidth and is replicable and combinable for providing multi-band coverage.

Figure 1:
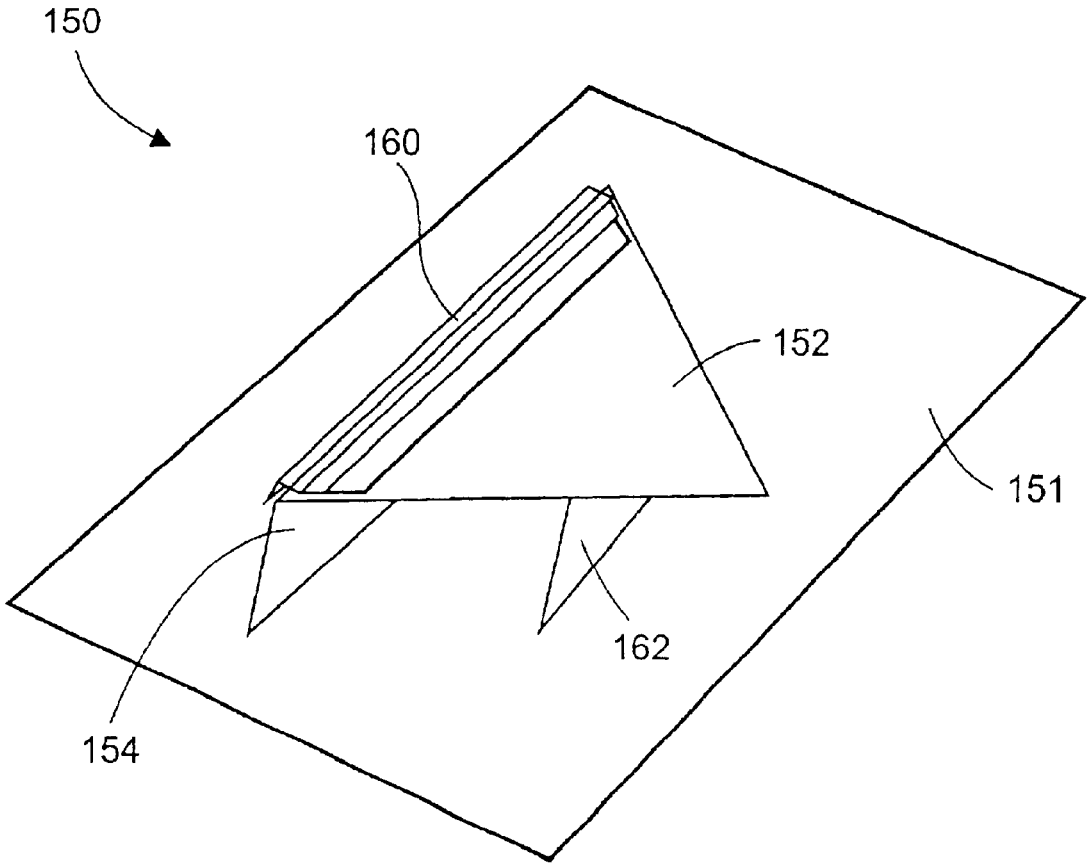
FIG. 1 illustrates a perspective view of a meanderline loaded antenna constructed in accordance with one embodiment of the present invention.

FIG. 1 illustrates a perspective view of a meanderline loaded antenna constructed in accordance with one embodiment of the present invention. As shown, antenna 150 is mounted on a ground plane 151, and generally includes a vertical planar conductor 154, a horizontal planar conductor 152, and a third conductor 162 connecting the horizontal planar conductor 152 to ground. In addition, a shaped conductor 160 is connected to the horizontal conductor 152 and extends towards vertical conductor 154.

The words vertical and horizontal are nominally used throughout this application with reference to a ground plane. Ground plane 151 may readily take the form of a finite planar conductor which may be oriented in an infinite number of positions without affecting the operation of the antenna relative thereto. Thus, the terms vertical and horizontal are not intended to limit the functional position of the claimed antennas.

Figure 2A:
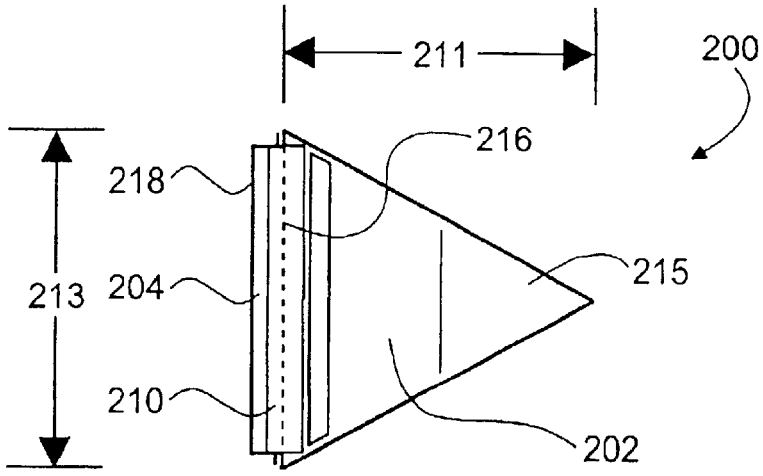
FIG. 2A illustrates a top view of an antenna constructed in accordance with one embodiment of the present invention.
Figure 2B:
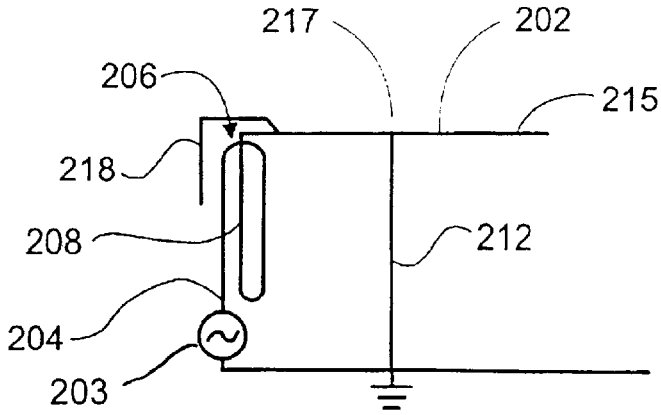
FIG. 2B illustrates a schematic side view of the antenna of FIG. 2A.
Figure 2C:
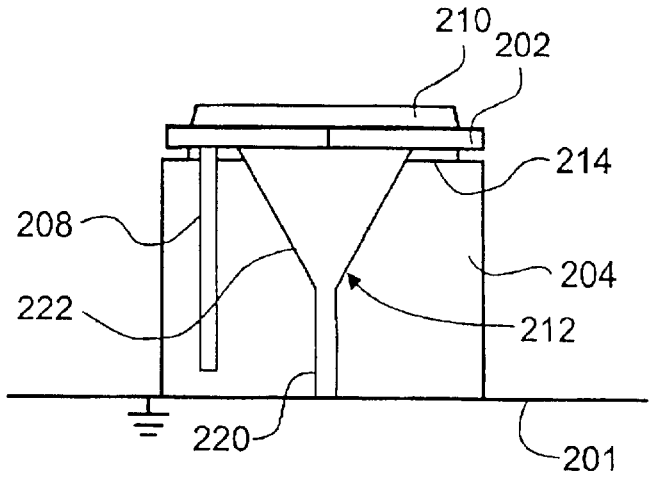
FIG. 2C illustrates an end view of the antenna of FIGS. 2A and 2B.

FIGS. 2A–C illustrate various views of an antenna configured in accordance with an embodiment of the present invention. FIGS. 2A and 2C show top and end views of antenna 200, while FIG. 2B shows a side schematic view.

Antenna 200 is formed on a ground plane 201 and generally includes a vertical planar conductor 204, a horizontal planar conductor 202, a meanderline 208 interconnecting the vertical and horizontal planar conductors 202, 204, a signal coupling means 203, and a third conductor 212 connecting the horizontal planar conductor 202 to ground. In addition, a shaped conductor 210 is connected to the horizontal conductor 202 and extends towards the vertical conductor 204.

Vertical planar conductor 204 is generally oriented perpendicularly with respect to ground plane 201. Signal coupling means 203 is connected to planar conductor 204 near the ground plane 201 and couples signals for the antenna with respect to ground plane 201. Coupling signals for the antenna is intended to mean both the excitation of antenna 200 with a transmission signal and the extraction of signals sensed by antenna 200 for processing by a receiver. Planar conductor 204 also includes a substantially straight edge 214 located along the top of conductor 204 relative to ground plane 201.

Horizontal planar conductor 202 is oriented substantially parallel to ground plane 201 and perpendicularly to planar conductor 204. Horizontal planar conductor 202 includes a substantially straight edge 216, which is oriented parallel and proximal to edge 214 of conductor 204. These two edges 214, 216 define a gap 206 which separates conductors 204 and 202. Gap 206 creates capacitance between planar conductors 204, 202 as determined by the spacing or size of gap 206 and the proximal lengths of edges 214 and 216. Planar conductor 202 is shown to have a maximum length dimension 211 and a maximum width dimension 213 in FIG. 2A. Length dimension 211 extends from the gap 206 to an end 215 which extends away from gap 206.

Planar conductor 202 may have a triangular shape as shown in FIGS. 1 and 2A, with one corner forming the extending end 215 in the direction away from gap 206. This particular triangular shape includes a pair of equilateral sides located on either side of the extending corner 215. Note that the triangular shape is not intended as a limitation on the present invention, and other geometric shapes can be used here as well.

Meanderline 208 is connected between planar conductors 204, 202 and across gap 206. Meanderline 208 may be constructed, for example, in accordance with conventional techniques, and generally includes two or more sequential sections having alternating impedance values. Although only two sections are shown for meanderline 208, the actual number used will depend upon the desired electrical length for the particular application. Meanderline 208 is physically mounted to vertical planar conductor 204, which creates a relative ground plane for meanderline 208.

FIG. 2C shows that meanderline 208 has the width of a typical transmission line for the purpose of creating the relative functional impedance values thereof for the design frequencies of antenna 200.

Shaped conductor 210 is used to further enhance the capacitance created between planar conductor 204 and 202. Conductor 210 is connected to horizontal conductor 202 and extends towards vertical conductor 204. A planar section 218 of conductor 210 is oriented substantially parallel to vertical planar conductor 204. Conductor 210 creates additional capacitance in relation to planar conductor 204 by means of proximity of the two surface areas.

For this reason, conductor 210 is adapted for adjustment with respect to conductor 204. In one embodiment, conductor 210 may be made from a malleable material, such as copper, which holds its shape after being bent into the desired position. Additionally, a more precise physical spacer made of dielectric material may be placed between the conductors 210 and 204. Other suitable configurations may be used here as well. Note that the addition of planar section 218 further increases capacitance by providing a greater proximal surface area.

As mentioned horizontal planar conductor 202 is connected to ground by a third conductor 212. Conductor 212 may take various forms and is shown in FIG. 2C to have a portion 220 formed as a transmission line. Transmission line portion 220 may extend up to horizontal conductor 202, or it may have some other suitable shape such as the impedance matching section 222. Conductor 212 is connected to horizontal conductor 202 at some point 217 between the gap and the extending end 215.

The point of connection 217 may affect the resulting bandwidth characteristics of the antenna 200. Point 217 may therefore be chosen to achieve a predetermined bandwidth characteristic for the antenna 200 or to otherwise determine such bandwidth characteristic. In one embodiment, point 217 may be chosen to maximize the functional bandwidth of antenna 200. For many applications, the position of point 217 may nominally lie between one-half and two-thirds of the length 211 from gap 206 to extending end 215. The location of point 217 may also be selected in accordance with physical construction requirements of the antenna.

Conductor 212 may be oriented in parallel to vertical planar conductor 204 with a certain amount of capacitance being created, depending upon the proximity of conductor 212 to planar conductor 204 and upon the relative surface area of conductor 212. Such capacitance may be varied through control of these two aspects.

Conductor 212 is typically designed to have a characteristic impedance along at least a portion 220 thereof which is comparable to the overall characteristic impedance of meanderline 208. The characteristic impedance of meanderline 208 is nominally equal to the square root of the product of the high and low impedance values thereof. FIG. 1 shows an example of a wider conductor 162 for connecting the horizontal planar conductor 152 to ground. Such a wider conductor 162 would have the necessary characteristic impedance values at lower frequencies. The positioning of conductor 162 along horizontal conductor 152 may be dictated by the desired impedance of conductor 162 at lower frequencies and the shape of horizontal conductor 152, however inter-conductor capacitance at such lower frequencies will be less of a design consideration.

Figure 3:
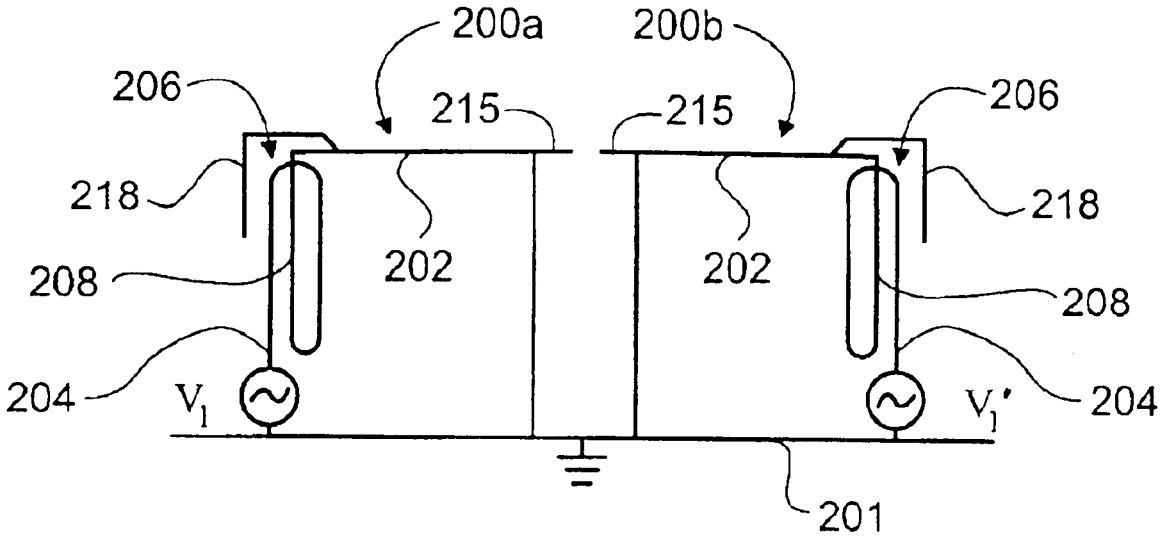
FIG. 3 illustrates a cross-sectional schematic view of a pair of opposed meanderline loaded antennas formed with the antenna of either FIGS. 1 or 2A–C.

FIG. 3 illustrates a cross-sectional schematic view of a pair of opposed meanderline loaded antennas. Antennas 200*a* and 200*b* of the opposed pair share the same ground plane 201, and have their extending ends 215 proximally located to one another. Note that antennas 200*a* and 200*b* are substantially identical, with identical components of each antenna having the same reference numbers. With the combination shown in FIG. 3, the performance of a single antenna 200 may be effectively doubled.

In one mode of operation, antenna 200*a* has a transmission signal coupled thereto, and the opposed antenna 200*b* has the inverted signal coupled thereto. This arrangement causes the horizontal planar conductors 202 of both elements to appear as a single radiating element for handling signals polarized horizontally with respect to ground plane 201. Similar reception performance is also achieved. In one embodiment, antennas 200*a*, 200*b* are symmetrically aligned. Recall that the horizontal planar conductors 202 are not limited to triangular shapes, and may be any other suitable shape, such as rectangular.

In operation, the opposed pair of meanderline loaded antennas 200*a*, 200*b* operates in the monopole or vertical polarization mode relative to ground plane 201, when the signal couplers $V_1$ and $V_1'$ are fed with the same signal. However, when the signal couplers $V_1$ and $V_1'$ are fed with inverse signals, the opposed pair operates in a loop mode for horizontal polarization relative to ground plane 201.

Figure 4:
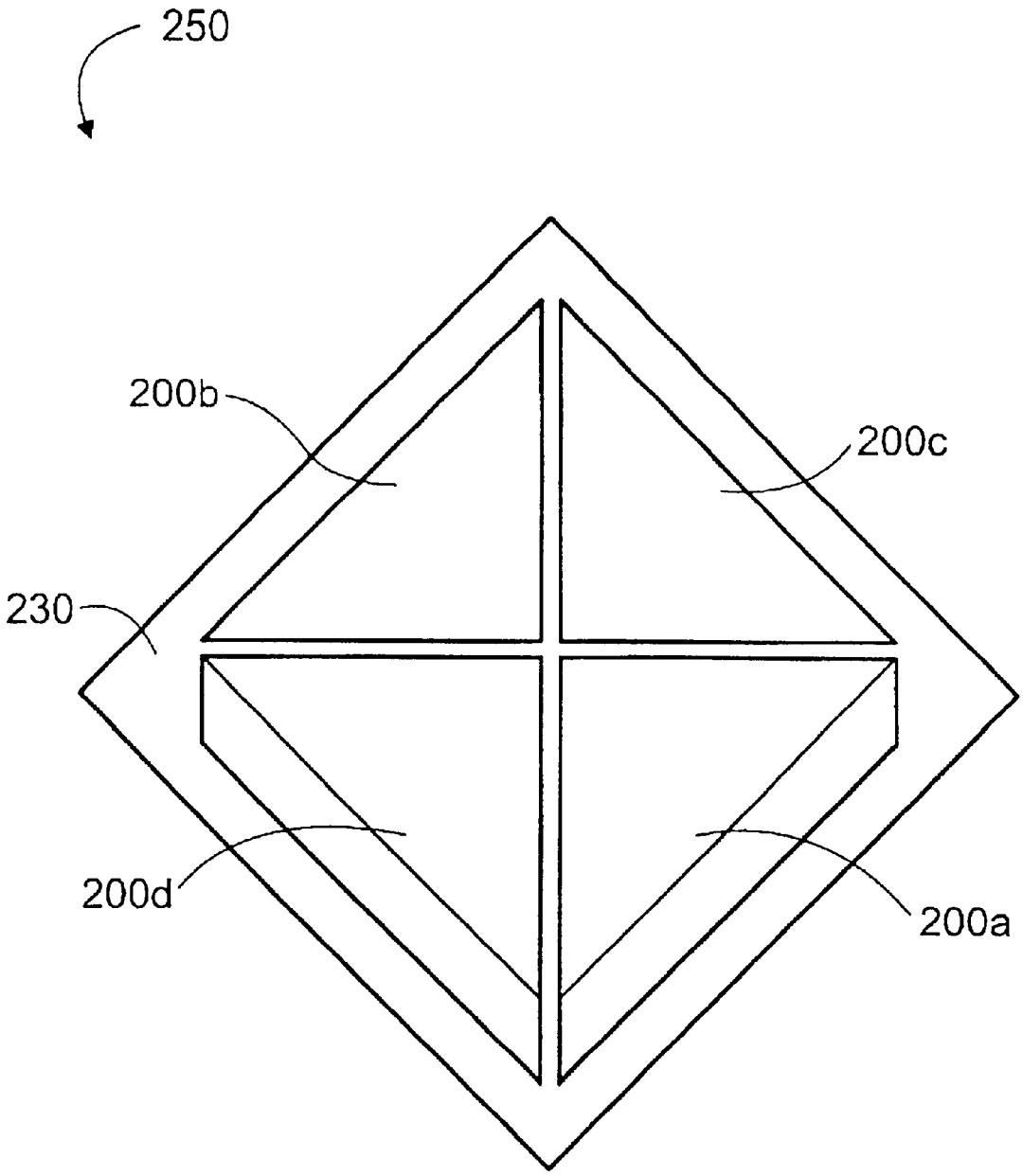
FIG. 4 illustrates a perspective view of two pairs of opposed meanderline loaded antennas arranged in a quadrature antenna configuration in accordance with one embodiment of the present invention.

FIG. 4 illustrates a perspective view of two pairs of opposed meanderline loaded antennas arranged in a quadrature antenna configuration in accordance with one embodiment of the present invention. As can be seen, the two opposed pairs of meanderline loaded antennas, 200*a*–200*b* and 200*c*–200*d*, share a conductive reference plane 230 (e.g., ground plane), and form a quadrature antenna 250. Both opposed pairs are identical, and are in orthogonal relationship with respect to each other, with the extending ends 215 (FIGS. 2A,B,C and 3) are all proximally located.

Note the symmetrical alignment of each of the opposed pairs. In this embodiment, the triangular shape of horizontal planar conductor 202 is used to allow the proximal location of all of the extending ends 215. Because the extending ends 215 of each pair are not directly connected, the circularly polarized signals created by the pairs are generated at the same central point in space and are not displaced from each other along a central axis orthogonal to ground plane 230. Such a configuration provides the circularly polarized signals so generated with high polarization purity.

Recall that the meanderline loaded antennas of each opposed pair are substantially identical thereby affording a high degree of symmetrical performance. This symmetry can be achieved early in the fabrication process, for example, where the four meanderline loaded antennas are manufactured from four sets of substantially matched components under similar process parameters (e.g., curing times and temperatures). For instance, all four meanderline loaded antennas could be built up, simultaneously subjected to necessary processing (e.g., same curing environment), and then assembled into the quad configuration referenced to a common reference plane.

Figure 5:
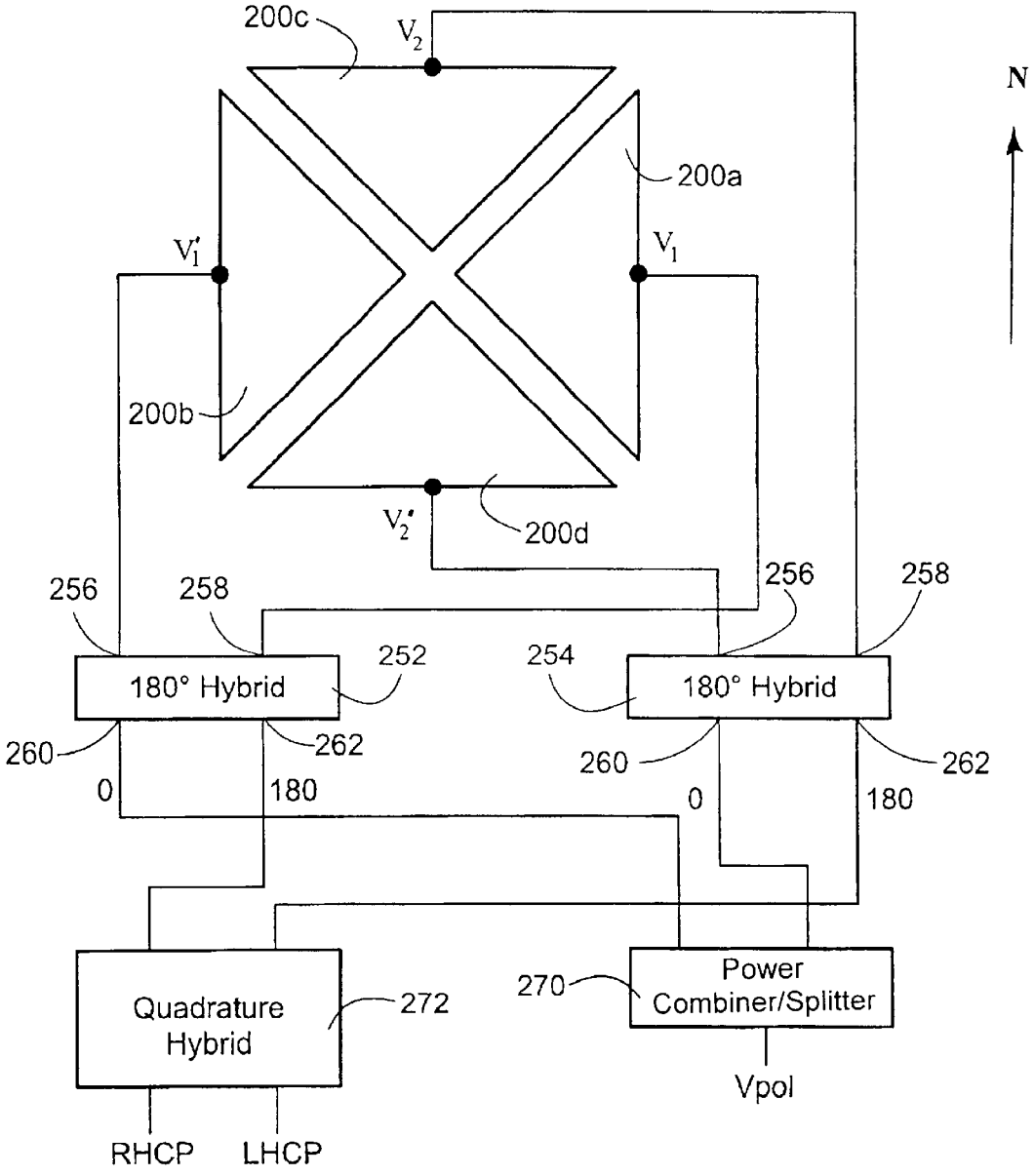
FIG. 5 illustrates a schematic view of the antenna of FIG. 4.

FIG. 5 illustrates a schematic view of the quadrature antenna of FIG. 4, and includes circuitry for providing quadrature coupling for the combined antenna in accordance with one embodiment of the present invention. This circuitry may be used simultaneously for both circularly polarized (RHCP and LHCP) and vertically polarized (Vpol) signals. Each of the opposed pairs 200*a*–200*b*, 200*c*–200*d* is coupled to a respective inverse hybrid circuit 252, 254, commonly known as 180° hybrids.

Each of the inverse hybrid circuits 252, 254 has a pair of antenna ports 256, 258 coupled to their respective opposed pair antennas 200*a*–200*b*, 200*c*–200*d*, and a pair of input/ output ports 260, 262. Transmit signals coupled to the "0" input/output port 260 are thereby coupled equally through antenna ports 256, 258, and transmit signals coupled to the "180" input/output port 262 are coupled inversely, or out of phase through antenna ports 256, 258. In a receive mode, the "0" input/output port 260 combines the signals from both antenna ports 256, 258 with an in-phase relationship, and the "180" input/output port 262 combines the signals from both antenna ports 256, 258 with an out-of-phase relationship.

The input/output ports 260, 262 are coupled by type, where the "0" ports 260 are coupled to a power combiner/splitter 270 for handling vertically polarized (Vpol) signals, and the "180" ports 262 are coupled to a quadrature hybrid 272 to handle circularly polarized signals. By this arrangement, horizontally polarized components of a received signal are coupled by inverse hybrids 252, 254 to quadrature hybrid 272.

Quadrature hybrid 272 (also referred to as a 90° hybrid) mixes the signals with a quadrature separation to allow detection of circularly polarized signals. The quadrature mixing is performed twice with the inverse hybrid signals in different order to allow detection of both left-hand circularly polarized signals (LHCP) and right-hand circularly polarized signals (RHCP). In this manner, and because of the circular polarization purity of antenna 250, both directions of polarization may be simultaneously used for independent signals.

Antenna 250 may also be simultaneously used to receive vertically polarized signals. The in-phase signals produced by inverse hybrids 252, 254 are combined to sum the contribution from all of the antenna elements.

Note that the circuitry functions in an analogous manner for purposes of transmitting signals, and a signal coupled to either of the Vpol, LHCP or RHCP ports will be transmitted accordingly as will be understood in light of this disclosure. Further note that the manufacturing process can be implemented so as to minimize process variations and increase antenna performance (e.g., by controlling symmetry, gain, and phase characteristics) as previously discussed.

As previously stated, the RHCP, LHCP, and Vpol modes are all simultaneously present. The relationship between the phase and magnitude of the signals generated in these modes is such that the angle of arrival for both elevation and azimuth can be determined over a wideband.

In particular, the phase difference between the signals at the RHCP and Vpol ports provides an unambiguous azimuthal angle of arrival. Similarly, the phase difference between the signals at the LHCP and Vpol ports provides an unambiguous azimuthal angle of arrival.

In addition, the ratio of the magnitudes at the Vpol and RHCP ports can be associated with the elevation angle of arrival. Likewise, the ratio of the magnitudes at the Vpol and LHCP ports can be associated with the elevation angle of arrival. For example, the gains at the LHCP port, the RHCP port, and the Vpol port for a given antenna system at a known operating frequency and elevation angle of arrival can be measured. This measured and known data can then be stored, for example, in a lookup table as shown here:

| RHCP or LHCP Gain (dB) | Vpol Gain (dB) | Angle of Elevation (°) |
|---|---|---|
| 7.6 | 9.9 | 0 |
| 8.3 | 8.8 | 25 |

-continued

| RHCP or LHCP Gain (dB) | Vpol Gain (dB) | Angle of Elevation (°) |
|---|---|---|
| 8.8 | 7.2 | 45 |
| 9.1 | 6.2 | 62 |
| 9.3 | 5.1 | 75 |
| 9.4 | 4.0 | 90 |

The lookup table can be indexed, for instance, by the ratio of the Vpol gain over the RHCP/LHCP gain. Thus, in a later application of the system where the actual angle of elevation is unknown, the respective gains can be measured to determine the index factor, and the angle of elevation corresponding to the index factor can be identified in the lookup table.

Note that the number of entries in the lookup table can be adjusted as necessary to provide the desired resolution and accuracy. Further note that a number of lookup tables can be employed, where each table is associated with an particular operating frequency. Alternatively, a single lookup table can be used for a range of operating frequencies. In such a case, the resolution of the data entries in the table should be fine enough so as to allow gain ratios associated with one operating frequency to be distinguished from those gain ratios associated with other operating frequencies.

Figure 7:
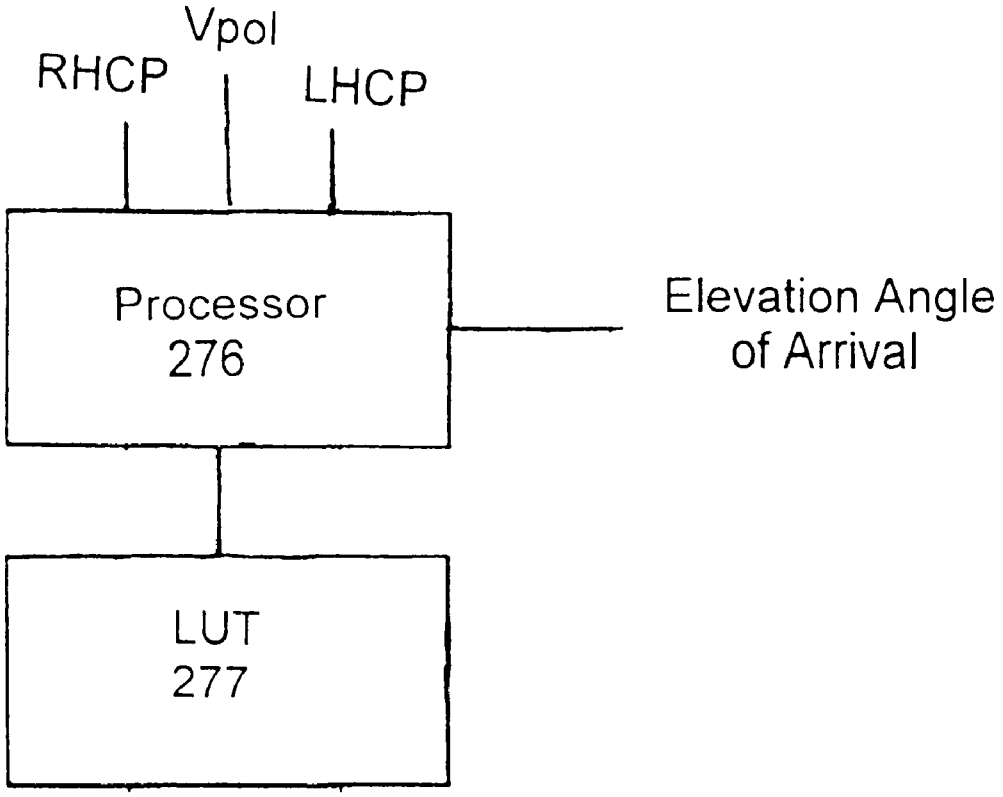
FIG. 7 illustrates a processing environment configured to determine elevation angle in accordance with one embodiment of the present invention.

The lookup table can be included in (or otherwise accessible by) a processor that is adapted to receive the magnitude information (e.g., gain) collected from the antenna ports RHCP/LHCP and Vpol. The processor can be programmed to determine the angle of elevation based on the collected magnitude information. Such an arrangement is illustrated in FIG. 7, where processor 276 is operatively coupled with a lookup table (LUT) 277. The processor is programmed to provide the elevation angle based on received signal magnitudes from antenna ports RHCP, LHCP, and Vpol. In alternative configuration, the lookup table 277 can be incorporated into the processor 276.

Figure 6:
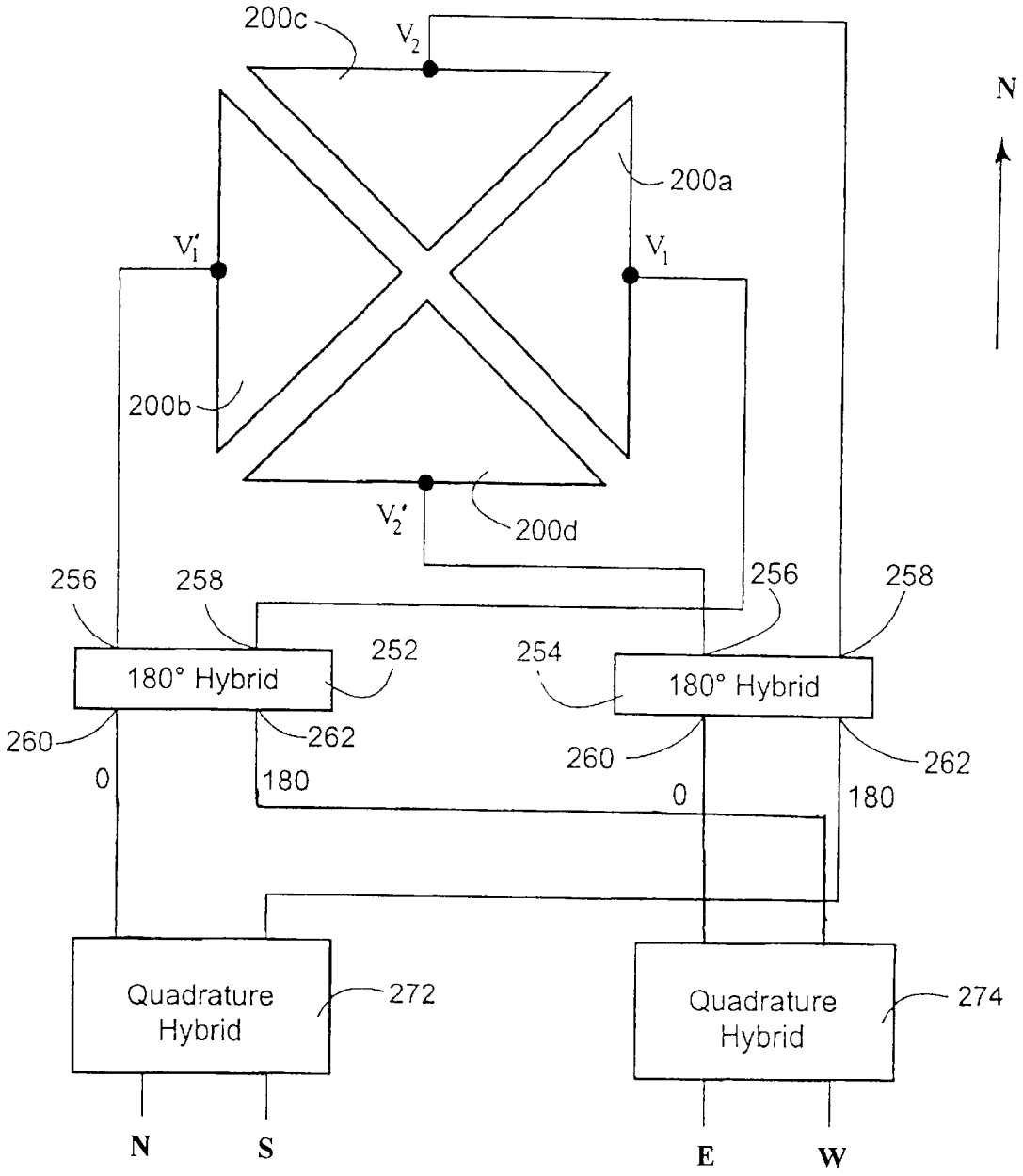
FIG. 6 illustrates a schematic view of a quadrature antenna configuration in accordance with another embodiment of the present invention.

FIG. 6 illustrates a schematic view of a quadrature antenna configuration in accordance with another embodiment of the present invention. This embodiment is similar to that illustrated in FIG. 5. However, an additional quadrature hybrid circuit 274 is provided as shown in place of the power combiner/splitter 270. In addition, the coupling between the input/output ports 260, 262 of the inverse hybrid circuits 252, 254 and the quadrature hybrid circuits 272 and 274 has been modified to provide four independent beams.

In particular, the quadrature hybrid circuit 272 is operatively coupled with the "0" port 260 of the inverse hybrid circuit 252 and the "180" port 262 of the inverse hybrid circuit 254. The quadrature hybrid circuit 274 is operatively coupled with the "0" port 260 of the inverse hybrid circuit 254 and the "180" port 262 of the inverse hybrid circuit 252. Four wideband, orthogonal beams are therefore simultaneously provided. More specifically, north (N) and south (S) beams are provided by quadrature hybrid 272, and east (E) and west (W) beams are provided by quadrature hybrid 274.

A specific embodiment of a beamforming quad MLA configured in accordance with the principles of the present invention is as follows: A quad configuration as illustrated in FIGS. 4 and 6, where the antenna structure is 5" high by 10" long by 10" wide, and has an operating frequency of 150 to 500 MHz. The following gains were measured:

| Frequency (MHz) | Gain (dBi) |
|---|---|
| 150 | 1.0 |
| 200 | 3.7 |
| 250 | 4.8 |
| 300 | 5.7 |
| 350 | 5.5 |
| 400 | 4.5 |
| 450 | 5.2 |
| 500 | 4.1 |

In this embodiment, the beams are cardioid-like patterns (heart-shaped), providing about 10 to 15 dB front-to-back ratio, and about 4 to 6 dBi of gain over a wideband (about 300 to 350 MHz in this example). Such a configuration can be used, for example, in wireless or cellular telephone applications. Note that beams pointing northeast (NE), southeast (SE), southwest (SW), or northwest (NW) can be synthesized by combining signals at two or more of the north, east, south, and west ports. For example, considering following table:

| Target Beam | Beam Combination |
|---|---|
| NE | N, E |
| SE | E, S |
| SW | S, W |
| NW | W, N |

Principals of the present invention can therefore be applied in wideband beamforming for quad MLA applications, and the problems associated with narrow-band solutions (e.g., strong mutual coupling effects) are avoided. Other quad MLA configurations will be apparent in light of this disclosure, and the present invention is not intended to be limited to any one embodiment. Parameters such as front-to-back ratio, gain, and bandwidth will depend on the particular implementation details, and can vary significantly.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A quad meanderline loaded antenna adapted to simultaneously provide RHCP, LHCP, and Vpol modes, the antenna comprising:

a first pair of opposed meanderline loaded antennas;

a second pair of opposed meanderline loaded antennas in orthogonal relationship with the first pair of opposed meanderline loaded antennas;

a first inverse hybrid operatively coupled to the first pair of opposed meanderline loaded antennas, and configured with a "0" input/output port and a "180" input/output port;

a second inverse hybrid operatively coupled to the second pair of opposed meanderline loaded antennas, and configured with a "0" input/output port and a "180" input/output port;

a quadrature hybrid operatively coupled to the "180" input/output ports of the first and second inverse hybrids, and configured with a left-hand circularly polarized (LHCP) signal port and a right-hand circularly polarized (RHCP) signal port; and a combiner/splitter operatively coupled to the "0" input/output ports of the first and second inverse hybrids, and configured with a vertically polarized (Vpol) signal port;

wherein an azimuthal angle of arrival associated with the antenna is provided by phase difference between signals at the RHCP and Vpol ports or by phase difference between signals at the LHCP and Vpol ports.

2. The antenna of claim 1 wherein the first and second pairs of opposed meanderline loaded antennas share a conductive reference plane.

3. The antenna of claim 1 wherein each meanderline loaded antenna associated with the first and second pairs of opposed meanderline loaded antennas has a triangular shape defining an extended end, and each of the extending ends is proximally located to one another.

4. The antenna of claim 1 wherein horizontally polarized components of a received signal are coupled by the first and second inverse hybrids to the quadrature hybrid.

5. The antenna of claim 1 wherein an elevation angle associated with the antenna is provided by a ratio of signal magnitude at the RHCP port and signal magnitude at the Vpol port, or by a ratio of signal magnitude at the LHCP port and signal magnitude at the Vpol port.

6. The antenna of claim 1 wherein a number of elevation angles are indexed in a lookup table by a ratio of signal magnitude at the RHCP port and signal magnitude at the Vpol port, or by a ratio of signal magnitude at the LHCP port and signal magnitude at the Vpol port.

7. The antenna of claim 1 wherein signal magnitude from each of the Vpol port and at least one of the RHCP or LHCP ports is provided to a processor that is programmed to determine an elevation angle associated with the antenna based on the signal magnitudes.

8. A quad meanderline loaded antenna adapted to simultaneously provide four independent beams, the antenna comprising:

a first pair of opposed meanderline loaded antennas;

a second pair of opposed meanderline loaded antennas in orthogonal relationship with the first pair of opposed meanderline loaded antennas;

a first inverse hybrid operatively coupled to the first pair of opposed meanderline loaded antennas, and configured with a "0" input/output port and a "180" input/output port;

a second inverse hybrid operatively coupled to the second pair of opposed meanderline loaded antennas, and configured with a "0" input/output port and a "180" input/output port;

a first quadrature hybrid operatively coupled to the "0" input/output port of the first inverse hybrid, and to the "180" input/output port of the second inverse hybrid, and configured with a north signal port and a south signal port; and a second quadrature hybrid operatively coupled to the "0" input/output port of the second inverse hybrid, and to the "180" input/output port of the first inverse hybrid, and configured with an east signal port and a west signal port.

9. The antenna of claim 8 wherein the first and second pairs of opposed meanderline loaded antennas share a conductive reference plane.

10. The antenna of claim 8 wherein each meanderline loaded antenna associated with the first and second pairs of opposed meanderline loaded antennas has a triangular shape defining an extended end, and each of the extending ends is proximally located to one another.

11. The antenna of claim 8 wherein beams provided at the north, south east, and west ports have cardioid-like patterns.

12. The antenna of claim 8 wherein the antenna provides 10 to 15 dB front-to-back ratio, and about 4 to 6 dBi of gain over a wideband.

13. The antenna of claim 8 wherein beams pointing northeast, southeast, southwest, or northwest can be synthesized by combining signals from two or more of the north, east, south, and west ports.

14. A method for manufacturing a quad meanderline loaded antenna, the method comprising:

providing a first pair of opposed meanderline loaded antennas;

providing a second pair of opposed meanderline loaded antennas in orthogonal relationship with the first pair of opposed meanderline loaded antennas;

operatively coupling a first inverse hybrid to the first pair of opposed meanderline loaded antennas, the first inverse hybrid configured with a "0" input/output port and a "180" input/output port;

operatively coupling a second inverse hybrid to the second pair of opposed meanderline loaded antennas, the second inverse hybrid configured with a "0" input/output port and a "180" input/output port;

operatively coupling a first quadrature hybrid to the "0" input/output port of the first inverse hybrid, and to the "180" input/output port of the second inverse hybrid, the first quadrature hybrid configured with a north signal port and a south signal port; and operatively coupling a second quadrature hybrid to the "0" input/output port of the second inverse hybrid, and to the "180" input/output port of the first inverse hybrid, the second quadrature hybrid configured with an east signal port and a west signal port.

15. The method of claim 14 wherein the first and second pairs of opposed meanderline loaded antennas are provided on a conductive reference plane.

16. The method of claim 14 wherein each meanderline loaded antenna associated with the first and second pairs of opposed meanderline loaded antennas is provided with a triangular shape that defines an extended end, and each of the extending ends is proximally located to one another.

17. The method of claim 14 wherein the antenna provides 10 to 15 dB front-to-back ratio.

18. The method of claim 14 wherein the antenna provides about 4 to 6 dBi of gain over a wideband.

19. The method of claim 14 wherein the meanderline loaded antennas of the first and second pair of opposed meanderline loaded antennas are substantially identical.

20. The method of claim 14 wherein the meanderline loaded antennas of the first and second pair of opposed meanderline loaded are manufactured from four sets of substantially matched components under substantially similar process parameters.

* * * * *

UNITED STATES PATENT AND TRADEMARK OFFICE

CERTIFICATE OF CORRECTION

PATENT NO. : 6,690,331 B1
DATED : February 10, 2004
INVENTOR(S) : John T. Apostolos It is certified that error appears in the above-identified patent and that said Letters Patent is hereby corrected as shown below:

Title page,
Items [12] and [75], Inventor, delete "Apotolos" insert -- Apostolos --

Column 11,
Line 5, delete "south east", insert -- south, east --

Signed and Sealed this

Fifteenth Day of March, 2005

JON W. DUDAS
*Director of the United States Patent and Trademark Office*